US007938288B2

(12) United States Patent
Oakner et al.

(10) Patent No.: US 7,938,288 B2
(45) Date of Patent: May 10, 2011

(54) UNIVERSAL DRAIN PAN

(75) Inventors: Stuart P. Oakner, Boca Raton, FL (US); Donna Ellen Oakner, Boca Raton, FL (US)

(73) Assignee: MSD Research, Inc., Boca Raton, FL (US)

( * ) Notice: Subject to any disclaimer, the term of this patent is extended or adjusted under 35 U.S.C. 154(b) by 319 days.

(21) Appl. No.: 12/220,614

(22) Filed: Jul. 25, 2008

(65) Prior Publication Data

US 2010/0018980 A1 Jan. 28, 2010

(51) Int. Cl.
*B65D 1/34* (2006.01)

(52) U.S. Cl. ..... 220/571; 206/557

(58) Field of Classification Search ..... 220/571, 220/571.1, 572, 573, 699; 62/285; 137/312, 137/313, 314; 141/311 A; 184/106; 296/38; 206/557

See application file for complete search history.

(56) References Cited

U.S. PATENT DOCUMENTS

| | | | | |
|---|---|---|---|---|
| 3,252,635 | A * | 5/1966 | Rosenhan | 222/527 |
| 3,920,144 | A * | 11/1975 | Callen | 220/533 |
| 6,283,144 | B1 * | 9/2001 | Kahn | 137/357 |
| 6,412,638 | B1 * | 7/2002 | Carter | 206/557 |
| 2003/0222087 | A1 * | 12/2003 | Frickel | 220/571 |

* cited by examiner

*Primary Examiner* — Anthony Stashick
*Assistant Examiner* — Jeffrey Allen
(74) *Attorney, Agent, or Firm* — Robert M. Downey, P.A.

(57) ABSTRACT

An auxiliary drain pan for catching liquid that leaks or overflows from an appliance, system or machinery includes a central well and a pan plate surrounding the central well. The pan plate has a top surface that is sloped downwardly towards the central well such that, when the drain pan is operatively positioned on a generally horizontal plane, liquid on the top surface flows into the confined area of the well, thereby minimizing the weight of liquid collected in the drain pan. The well includes a drain line connection port and a removable wall segment for optional attachment of a water detection device. Parallel score lines in the pan plate, extending both longitudinally and transversely on all sides, define removable areas for adjustment of the overall size and shape of the drain pan, thereby allowing for customized sizing at the installation site.

8 Claims, 5 Drawing Sheets

UNIVERSAL DRAIN PAN

BACKGROUND OF THE INVENTION

1. Field of the Invention

The present invention relates generally to drain pans and, more particularly, to an auxiliary drain pan that is adjustable in size and shape and is structured to minimize pooling of collected liquid, thereby reducing the weight load on the drain pan.

2. Discussion of the Related Art

In various systems and equipment, there is a need to transfer and/or drain liquid to another location. For example, in air conditioning and refrigeration systems, condensation naturally occurs as warm, humid air passes over the exterior of the evaporator coil. Typically, the condensation drips from the evaporator coil into a condensate collection pan positioned below the evaporator coil. From the collection pan, the liquid condensate is directed through a drain line that leads to a safe discharge location, such as the exterior of a building.

Occasionally, problems can occur as a result of a failure in the normal liquid transfer or drainage system. For instance, in an air conditioning system the primary condensate collection pan, usually made of metal materials, is susceptible to rust and corrosion. This can lead to a leak developing in the primary collection pan, causing water damage to the area below the unit. Additionally, mildew and other microbial growths, combined with dust and other particulate, accumulate in the condensate pool. Over time, this accumulation can eventually cause the drain line to become clogged. When this happens, the continually produced condensate fills within the primary condensate collection pan and eventually overflows. The overflow of condensate from a continuously running HVAC unit can cause extensive and costly damage to the interior of a building or home. This is a common problem that is well known in the industry.

To prevent overflow of the primary condensate collection pan, a shut-off switch can be installed. The shut-off switch senses water level in the primary pan and, when the water level reaches a predetermined height, the shut-off switch disables the HVAC system, thereby preventing further condensate accumulation and overflow of the primary pan. A secondary or emergency overflow pan can be installed as an alternative or additional precaution. The secondary pan is installed below the air conditioning unit and is sized, configured and positioned to catch water that might overflow the primary condensate collection pan in the unit. In many cases, the secondary pan is suspended on wires and hangs below the HVAC unit. This emergency overflow pan can also be fitted with a shut-off switch and/or a drain line connection.

While secondary pans are highly effective and can prevent extensive and costly water damage in the event of a primary pan overflow, they too have certain inherent problems and shortcomings. In particular, secondary pans need to be fairly large (i.e., larger than the HVAC unit and primary pan) in order to catch water that may overflow at any area around the base of the HVAC. Accordingly, the secondary or overflow pan provides a large pooling area that, if filled with water, would place a significant weight load on the secondary pan and suspending structure. In order to prevent excess accumulation, or pooling of condensate, the secondary pan needs to be pitched correctly at installation so that water is directed to the drain outlet and into the connected drain line. Unfortunately, the secondary pan is not always installed properly, and the pitch of the pan causes the water to collect away from the drain outlet. And, even if the secondary pan is installed properly, with the correct pitch, the drain outlet or drain line may become clogged as a result of accumulated mildew, dust and other obstructions. In either instance, if the water is not able to freely flow out of the drain outlet through the drain line, condensate will begin to accumulate and pool within the secondary pan. Eventually, the substantial weight load of the accumulated water can cause the secondary pan to buckle, thereby spilling the accumulated water and rendering the secondary drain pan useless.

Accordingly, there remains a need for an improved secondary or auxiliary drain pan that provides a confined area for collection and draining of liquid without excessive pooling of liquid, and thereby reducing the weight load on the drain pan. There is a further need to provide an improved auxiliary drain pan that can be easily adjusted in overall size and shape for customized fitting of the drain pan at the installation site.

OBJECTS AND ADVANTAGES OF THE INVENTION

Considering the foregoing, it is a primary object of the present invention to provide a universal drain pan that has a confined area for collection and pooling of liquid in a manner that significantly reduces the weight and stress exerted on the drain pan and any supporting structure.

It is a further object of the present invention to provide a universal drain pan that provides a centrally positioned well for collecting liquid in a confined pooling area, thereby minimizing the weight load exerted on the drain pan and the supporting structure.

It is still a further object of the present invention to provide a universal drain pan that can be easily adjusted in overall size and shape for customized fitting of the drain pan at the installation site.

It is still a further object of the present invention to provide a universal drain pan that includes a central well for pooling of liquid in a confined area to minimized the weight load exerted on the drain pan and supporting structure, and further wherein the drain pan is structured for customized sizing at the installation site.

It is yet a further object of the present invention to provide a universal drain pan, as described above, and further wherein the universal drain pan is adapted for multiple types of installation, including suspended installation and floor supported installation.

It is still a further object of the present invention to provide a universal drain pan, as described above, and further wherein the universal drain pan is adapted for use with a wide variety of appliances, systems and machinery that have a need to collect liquid.

It is still a further object of the present invention to provide a universal drain pan as described above, which is adapted for use with all HVAC handler unit makes and models.

These and other objects of the present invention are more readily apparent with reference to the detailed description and accompanying drawings.

SUMMARY OF THE INVENTION

The present invention is directed to a universal drain pan for catching liquid that leaks or overflows from an appliance, system or machinery. The universal drain pan includes a central well and an integral pan plate that surrounds the well. The pan plate slopes upwardly from all sides of the well to outer peripheral edges. More specifically, a top surface of the pan plate is sloped to direct liquid into the well. Accordingly, when the universal drain pan is operatively positioned on a generally horizontal plane, liquid that drips onto the top surface of the pan plate naturally flows, by gravity, into the central well. The floor of the well is lower than the top surface of the pan plate surrounding the well, allowing liquid to pool within the confined area defined by the well. The well includes a drain line connection port for ease of connection of a drain line, such as a PVC pipe. This allows liquid collected in the well to be immediately drained from the pan. A removable divider wall can be inserted in the well for optional attachment of a water detection device. In this instance, the drain line connection port can be plugged and, if the water level rises to a pre-determined height within the well, the water detection device can disable the appliance that is producing the liquid.

The universal drain pan is specifically structured to allow for customized installation to accommodate a variety of installation methods, as well as sizes and shapes. Specifically, the universal drain pan is provided with parallel score lines on the pan plate, extending both longitudinally and transversely on all sides, to define removable areas. By cutting or bending and breaking along the score lines, areas of the pan plate can be removed in order to properly size the universal drain pan for the particular appliance, as well as to fit the universal drain pan plate adjacent structure. Accordingly, the universal drain pan can be easily adjusted in overall size and shape for customized fitting at the installation site. Optional corner dishes clip onto the drain pan plate for surrounding supporting structure, such as the legs of a stand. The corner dishes catch liquid which may run down the supporting structure and direct the liquid onto the pan plate and into the well. The pan plate may further be provided with integrally formed hooks, loops, eyelets or other elements for attaching the universal drain pan to supporting structure such as suspending wires or bars.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
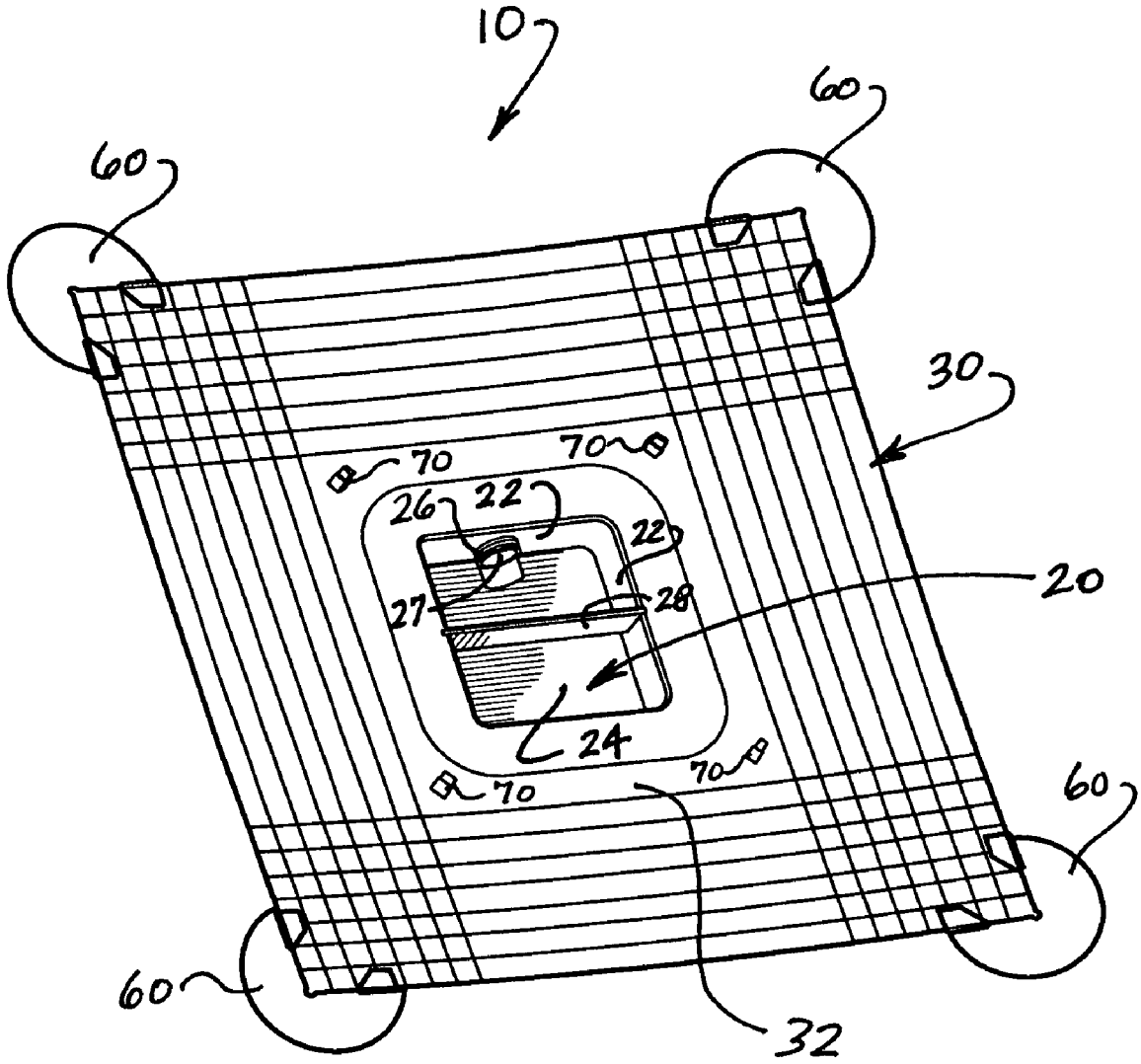
FIG. 1 is a top perspective view of the universal drain pan of the present invention, in accordance with a preferred embodiment thereof.
Figure 2:
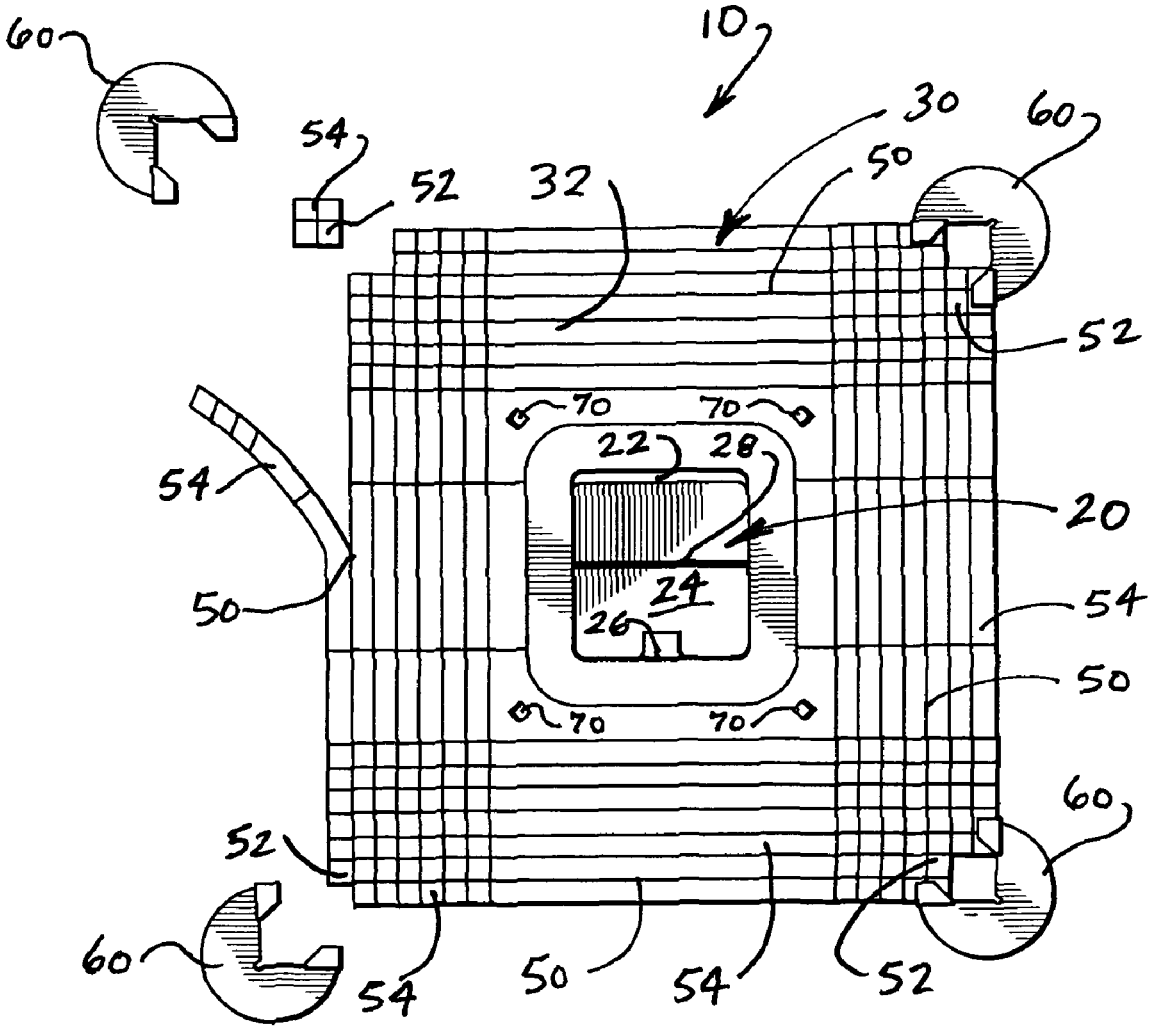
FIG. 2 is a top plan view of the universal drain pan shown with portions of the pan plate removed along score lines and two of four corner dishes removed.

The universal drain pan is shown throughout the several views of the drawing and is generally indicated as 10. Referring initially to FIGS. 1 and 2, the universal drain pan 10 includes a central well 20 surrounded by a pan plate 30. The central well 20 has vertical side walls 22 extending from the pan plate 30 down to a floor 24 of the well. In a preferred embodiment, the floor 24 of the well is positioned approximately 1" to 3" below the pan plate 30.

Figure 3:
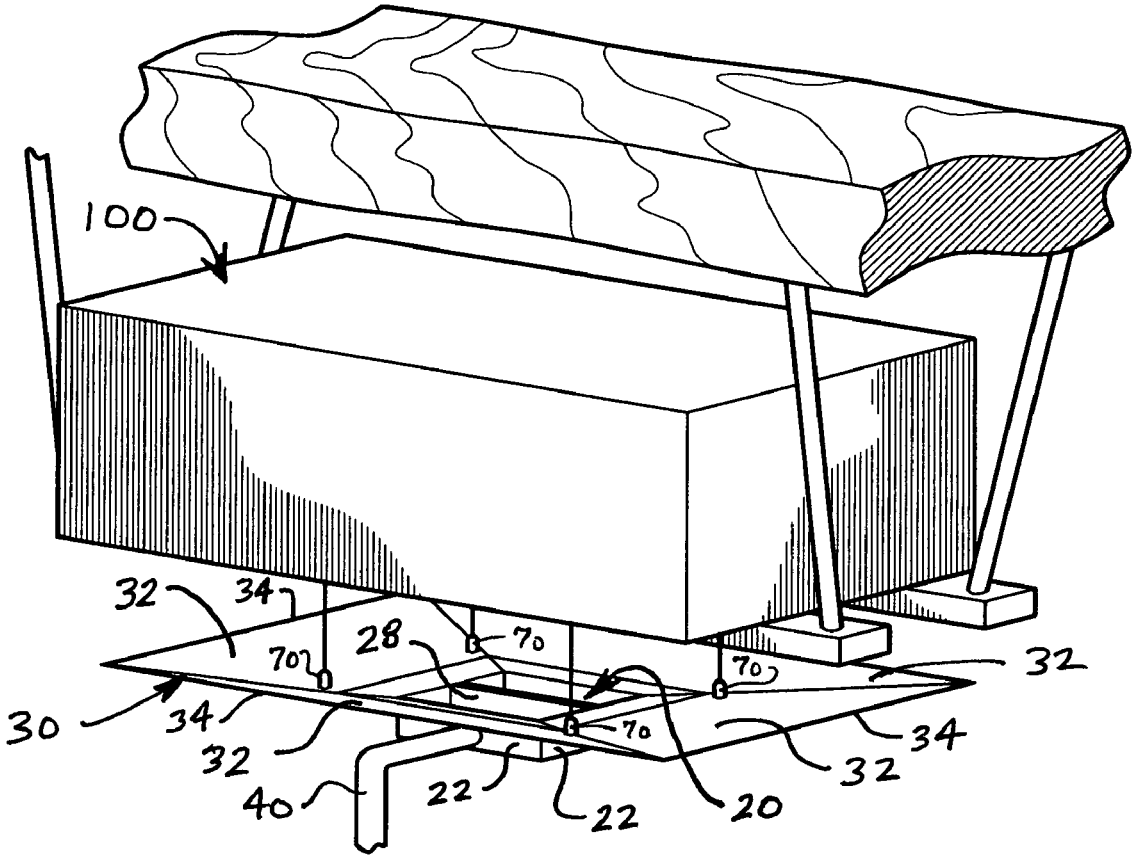
FIG. 3 is a perspective view showing the universal drain pan of the present invention suspended below a ceiling mounted HVAC handler unit.

As best seen in FIG. 3, a top surface 32 of the pan plate 30 is sloped from the outer peripheral edges 34 downwardly to the central well 20. In the example shown in the drawing, the well 20 has four sides and is square or rectangular in shape when viewed from the top, as seen in FIG. 2. In order to slope the entire top surface 32 of the pan plate 30 in this particular configuration, the pan plate 30 has four sections, as seen in FIG. 3, that slope downwardly towards the central well 20. Other well configurations, such as circular or triangular, would require an accommodating pan plate design to slope the entire top surface 32 towards the well 20. In all conceivable embodiments, the top surface 32 of the pan plate 30 is sloped to direct liquid into the well 20 when the drain pan 10 is operatively positioned on a generally horizontal plane. Specifically, when the universal drain pan 10 is properly positioned in the generally horizontal plane, as seen in FIGS. 3-6, liquid that drips onto the top surface 32 of the pan plate naturally flows, by gravity, into the central well 20.

Figure 5:
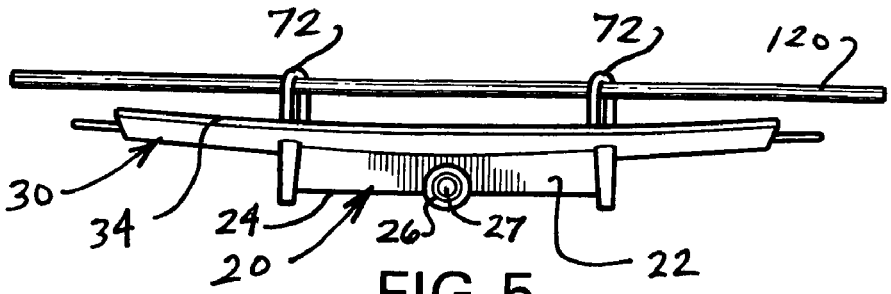
FIG. 5 is an isolated side elevational view of the universal drain pan shown suspended on the bars of FIG. 4.

Referring to FIGS. 1 and 5, a drain line connection port 26 in the central well 20 allows for connection of a drain line 40, such as a PVC pipe, for directing liquid that collects in the well 20 to another location, such as a discharge site. In a preferred embodiment, the drain line connection port 26 is integrally formed with a side wall 22 and floor 24 of the well 20 so that at least a portion of the port opening 27 is lower than the floor 24 of the well, thereby promoting gravity flow of liquid from the well 20 into the connected drain line. The central well 20 may further be provided with a removable wall section 28. In a preferred embodiment, the removable wall section 28 forms a divider wall extending across the central well. The wall section 28 is removably received within slots formed in opposing vertical walls 22 of the well. The removable wall section 28 provides a convenient structure for attachment of an optional water detection device, such as a liquid level sensor and shut-off switch. When the removable wall section 28 and water detection device are installed in the well, the drain line connection port 26 can be plugged and, if the water level rises to a pre-determined height within the well 20 the water detection device can disable the appliance 100 (e.g., an HVAC unit) that is producing the liquid.

The universal drain pan 10 is specifically structured to allow for customized installation to accommodate a variety of installation methods, as well as sizes and shapes. As seen in FIGS. 1 and 2, the pan plate 30 of the universal drain pan 10 is provided with parallel score lines 50 extending both longitudinally and transversely on all sides, to define removable areas. By cutting or bending and breaking along the score lines 50, any of the areas 54 within the boundaries score lines 50 can be removed in order to properly size the universal drain pan 10 for the particular installation requirements, as well as to fit the universal drain pan around adjacent structure. For instance, the grid sections 52 formed in each of the four corners of the pan plate 30, by the intersecting longitudinal and transverse score lines 50, allows for removal of any size corner notch to fit the pan plate 30 around a leg structure, such as the support legs 112 of the stand 110 shown in FIG. 6. Furthermore, the entire length of any side of the pan plate 30 can be removed along the length of the longitudinal or transverse score lines 50 to thereby reduce the overall width or length of the drain pan 10. It should be noted that the drain pan 10 may be manufactured of any of a variety of materials, including plastic compositions or metal alloys. Removal of any of the areas 54 of the pan plate 30 can be accomplished by either cutting along the score lines 50 or bending the pan plate along the score lines 50 to break the desired areas 54 away from a remainder of the pan plate 30.

Figure 6:
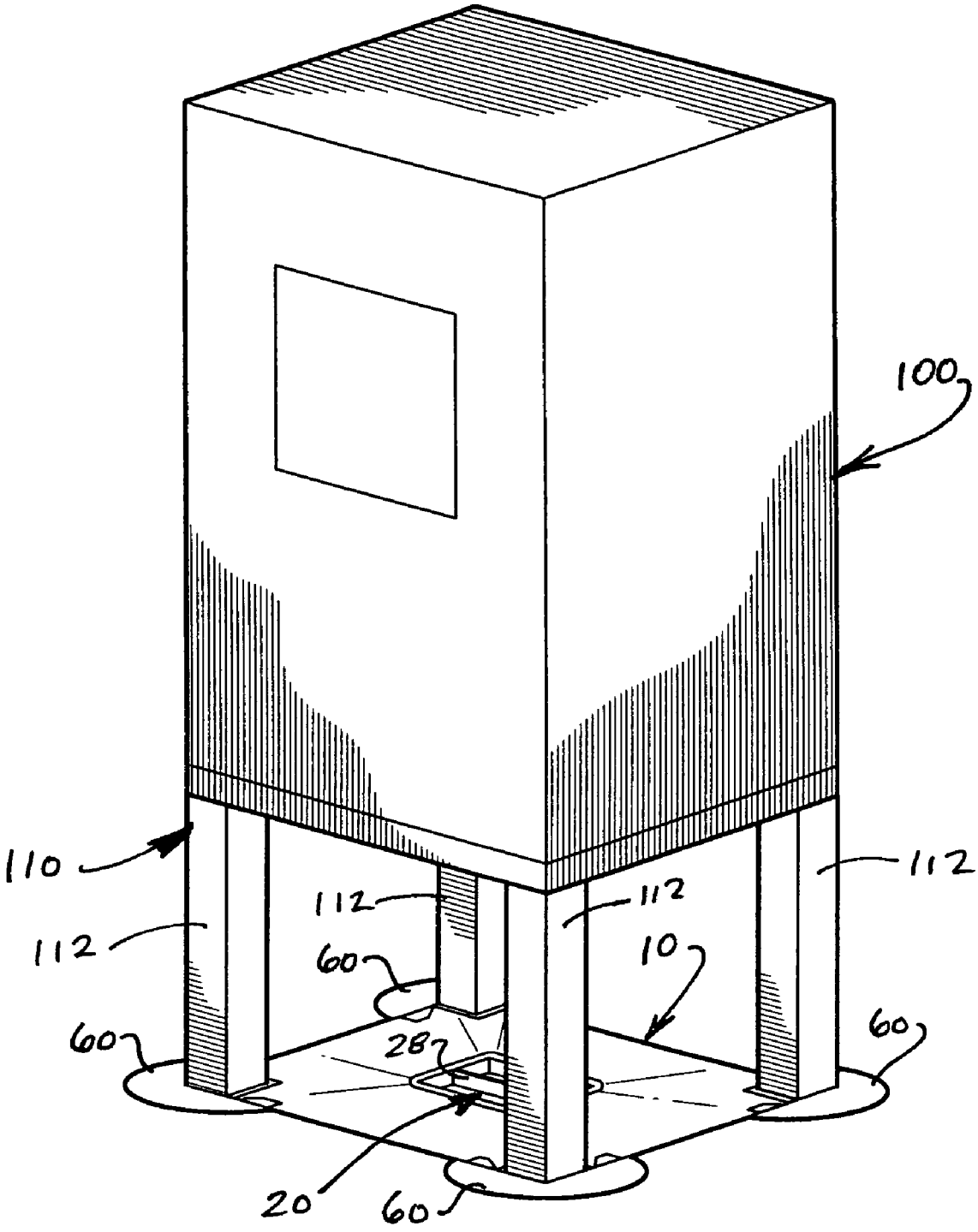
FIG. 6 is a perspective view showing the universal drain pan of the present invention positioned below an HVAC handler unit that is supported on a stand, with the universal drain pan resting on a floor surface or suspended below the stand.

Referring to FIGS. 1, 2 and 6, corner dishes 60 clip to the edges of the pan plate 30 to surround vertical structures, such as the support legs 112 of an HVAC handler unit stand 110, that are fitted within the notched out corners of the pan plate 30. The corner dishes 60 complete a surrounding surface at the corners of the drain pan 10 so that liquid dripping from the corners of the unit 100 supported on the stand 110 is captured by the corner dishes 60 and directed onto the pan plate 30 and into the central well 20.

Figure 4:
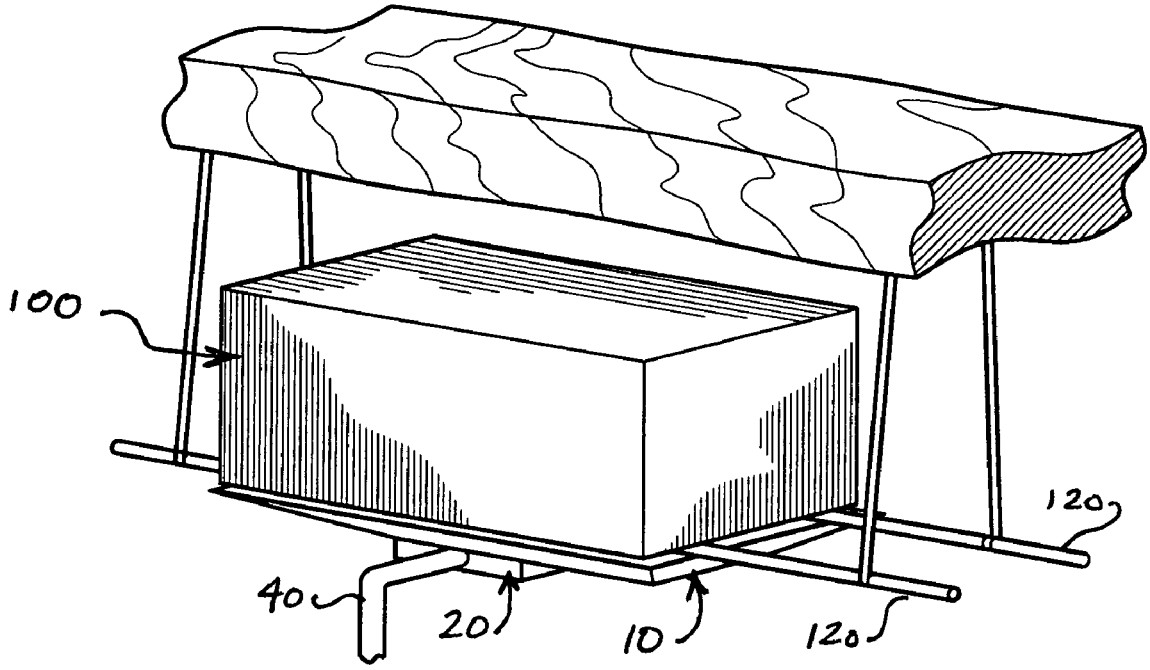
FIG. 4 is a perspective view showing the universal drain pan of the present invention supported on a pair of spaced bars used for mounting the HVAC handler unit to a ceiling structure.

The universal drain plate 10 is adapted for all types of installations, including: suspended installation, as seen in FIG. 3; cross bar attachment, as seen in FIGS. 4 and 5; and floor supported installation, as seen in FIG. 6. To accommodate a wire suspended installation under an appliance, such as an HVAC handler unit 100 (see FIG. 3), the pan plate 30 is provided with an integral eyelets 70. The eyelets 70 or hooks allow for connection of the suspending wires or cables extending down from the unit or mounting structure. Alternatively, as seen in FIGS. 4 and 5, the pan plate may be provided with loops 72 that are sized and configured for passage of plastic or steel bars 120 therethrough. In this instance, an HVAC handler unit supported on the parallel spaced bars allows for installation of the universal drain pan. Specifically, the horizontal, spaced bars 120 are passed through the loops 72 extending upwardly from the pan plate 30 so that the universal drain pan 10 essentially hangs from the bars 120 directly below the HVAC handler unit 100 that is supported on the bars 120, as seen in FIG. 4. The universal drain pan 10 is also suited to rest on a floor or other horizontal surface below an appliance. For example, in FIG. 6 the universal drain pan 10 is sized and fitted to rest on the floor below a stand supported HVAC handler unit 100. In this instance, the corners of the pan plate 30 are notched out to fit the pan plate 30 around the four vertical support legs 112 of the stand 110 and the corner dishes 60 are installed. It should be noted that the universal drain pan 10 can optionally be suspended below the stand 110 in the example of FIG. 6.

While the present invention has been shown and described in accordance with preferred and practical embodiments thereof, it is recognized that departures from the instant disclosure are fully contemplated within the spirit and scope of the invention.

What is claimed is:

1. A liquid collection pan for collecting liquid dripping from an apparatus supported above the liquid collection pan, the liquid collection pan comprising:

a central well defining a confined liquid collection reservoir and including a floor and vertical side walls extending upwardly from said floor;

a substantially rigid pan plate integrally formed with said central well and surrounding said central well, and said pan plate including a top surface that is sloped downwardly towards top edges of said vertical side walls of said central well, and said top surface being structured and disposed for directing liquid that drips onto said top surface into said well when said collection pan is operatively positioned on a generally horizontal plane;

a plurality of score lines formed in said pan plate and including longitudinally extending score lines and transversely extending score lines, and said longitudinally extending score lines and said transversely extending score lines intersecting at corners of said pan plate to define grid sections, and said plurality of parallel score lines further defining a plurality of selectively removable areas that are detachable from a remainder of said pan plate for altering the size and configuration of said pan plate, and said plurality of selectively removable areas including areas of said grid sections that are selectively removable from any of said corners of said pan plate to create a square notch; and a plurality of corner dishes each being structured for removable attachment to two adjacent edges of said pan plate at one of said corners of said pan plate, and each of said plurality of corner dishes and a correspondingly positioned one of said square notches being structured and disposed to surround a support leg of the apparatus, and each of said plurality of corner dishes including a top surface disposed in fluid flow communication with the top surface of said pan plate when said corner dish is attached to the two adjacent edges of said pan plate for directing liquid that drips onto the top surface of said corner dish to the top surface of said pan plate and into said central well.

2. The liquid collection pan as recited in claim 1 wherein said central well includes a drain line connection port including a port opening for connecting a drain line thereto, and said drain line connection port being structured and disposed to direct liquid from said central well through said port opening and into a drain line connected to said drain line connection port.

3. The liquid collection pan as recited in claim 2 further comprising:

a removable wall segment structured and disposed for removable placement within said central well.

4. The liquid collection pan as recited in claim 3 wherein said plurality of parallel score lines are structured and disposed to bend and separate in order to selectively remove one or more of said plurality of removable areas of said pan plate.

5. A liquid collection pan for collecting liquid dripping from an apparatus supported above the liquid collection pan, the liquid collection pan comprising:

a central well defining a confined liquid collection reservoir and including a floor and vertical side walls extending upwardly from said floor;

a substantially rigid pan plate integrally formed with said central well and surrounding said central well, and said pan plate including a top surface that is sloped downwardly towards top edges of said vertical side walls of said central well, and said top surface being structured and disposed for directing liquid that drips onto said top surface into said well when said collection pan is operatively positioned on a generally horizontal plane;

a plurality of score lines formed in said pan plate and including longitudinally extending score lines and transversely extending score lines, and said longitudinally extending score lines and said transversely extending score lines intersecting at corners of said pan plate to define grid sections, and said plurality of parallel score lines further defining a plurality of selectively removable areas that are detachable from a remainder of said pan plate for altering the size and configuration of said pan plate, and said plurality of selectively removable areas including areas of said grid sections that are selectively removable from any of said corners of said pan plate to create a square notch;

a plurality of corner dishes each being structured for removable attachment to two adjacent edges of said pan plate at one of said corners of said pan plate, and each of said plurality of corner dishes and a correspondingly positioned one of said square notches being structured and disposed to surround a support leg of the apparatus, and each of said plurality of corner dishes including a top surface disposed in fluid flow communication with the top surface of said pan plate when said corner dish is attached to the two adjacent edges said pan plate for directing liquid that drips onto the top surface of said corner dish to the top surface of said pan plate and into said central well; and a plurality of eyelets integrally formed on said top surface of said pan plate, and said plurality of eyelets being structured and disposed for connection of suspension wires for suspending the liquid collection pan below the apparatus.

6. The liquid collection pan as recited in claim 5 wherein said central well includes a drain line connection port including a port opening for connecting a drain line thereto, and said drain line connection port being structured and disposed to direct liquid from said central well through said port opening and into a drain line connected to said drain line connection port.

7. The liquid collection pan as recited in claim 6 further comprising:

a removable wall segment structured and disposed for removable placement within said central well.

8. The liquid collection pan as recited in claim 7 wherein said plurality of parallel score lines are structured and disposed to bend and separate in order to selectively remove one or more of said plurality of removable areas of said pan plate.

* * * * *